US005588347A

United States Patent [19]

Jepsen

[11] Patent Number: 5,588,347

[45] Date of Patent: Dec. 31, 1996

[54] HYDRAULIC AXIAL PISTON MACHINE WITH AN INCLINED PLATE

[75] Inventor: Hardy P. Jepsen, Nordborg, Denmark

[73] Assignee: Danfoss A/S, Nordborg, Denmark

[21] Appl. No.: 464,689

[22] PCT Filed: Jan. 12, 1994

[86] PCT No.: PCT/DK94/00021

§ 371 Date: Jun. 6, 1995

§ 102(e) Date: Jun. 6, 1995

[87] PCT Pub. No.: WO94/16224

PCT Pub. Date: Jul. 21, 1994

[30] Foreign Application Priority Data

Jan. 18, 1993 [DE] Germany ..... 43 01 121.7

[51] Int. Cl.[6] ..... F01B 3/00

[52] U.S. Cl. ..... 92/12.2; 92/57; 92/71; 417/269; 74/60; 91/499

[58] Field of Search ..... 92/57, 12.2, 71; 417/269; 74/60; 91/499

[56] References Cited

U.S. PATENT DOCUMENTS 5,017,095 5/1991 Burgess et al. ..... 417/269

*Primary Examiner*—Thomas E. Denion

*Attorney, Agent, or Firm*—Lee, Mann, Smith, McWilliams, Sweeney & Ohlson

[57] ABSTRACT

A hydraulic axial piston machine is disclosed, having an inclined plate (7), on which a slider shoe (9) of at least one piston slides on relative movement between a cylinder body (2) receiving the piston and the inclined plate (7), and a pressure plate (10) articulated on the cylinder body (2) and holding the slider shoe (9) in engagement with the inclined plate. It is desirable for such a machine also to be operable with a hydraulic fluid that has no lubricating properties. For that purpose, between the pressure plate (10) and the cylinder body (2) there is arranged a bearing element (18) with a bearing surface (19) of plastics material, which slides with low friction on a counterpart (15) made of metal lying against the bearing surface (19).

14 Claims, 3 Drawing Sheets

HYDRAULIC AXIAL PISTON MACHINE WITH AN INCLINED PLATE

BACKGROUND OF THE INVENTION

The invention relates to a hydraulic axial piston machine, having a inclined plate, on which a slider shoe of at least one piston slides on relative movement between a cylinder body receiving the piston and the inclined plate, and a pressure plate articulated on the cylinder body and holding the slider shoe in engagement with the inclined plate.

In machines of that kind, on rotation of the cylinder body with respect to the inclined plate, or on rotation of the inclined plate with respect to the cylinder body, the piston is moved axially. During the pressure stroke, that is to say, on decrease in the volume of the cylinder moved by the piston, the inclined plate exerts a pressure on the slider shoe. During a suction stroke, on the other hand, the pressure plate has to hold the slider shoe in engagement with the inclined plate. In accordance with the axial back and forth movements of the piston, the pressure plate must also tilt back and forth, the tilting angle range extending, for example, from about −15° to about +15°. On each rotation, the entire tilting angle range has to be passed through, once in the positive direction and once in the negative direction.

Since the articulated connection between the cylinder body and the pressure plate has to accommodate considerable forces, considerable friction is generated there. So that the losses and the wear and tear caused by the friction are not allowed to become too great, it is known to lubricate this articulation. The oil that is already present, serving as hydraulic fluid, is normally used for that purpose. But this leads to the disadvantage that the selection of hydraulic fluids is restricted to hydraulic oils. Even here, choice is not unlimited since not all oils have the same good lubricating properties. In the past, there has therefore been an increasing tendency to use synthetic oils, but these are being regarded with growing disfavour from the point of view of compatibility with the environment.

SUMMARY OF THE INVENTION

The invention is therefore based on the problem of being able to operate a hydraulic axial piston machine even with a hydraulic fluid that has relatively poor or even no lubricating properties.

This problem is solved in a hydraulic axial piston machine of the kind mentioned in the introduction in that between pressure plate and cylinder body there is arranged a bearing element with a bearing surface of plastics material, which slides with low friction on a counterpart made of metal lying against the bearing surface.

The lubricating function, which was otherwise performed by a continually freshly supplied hydraulic fluid, for example, an oil, is now replaced by the use of a machine element, namely, the bearing element, which works together with the counterpart with low friction. Since the plastics material is provided only in the bearing element, the machine can also be subjected to the same forces as before. Mechanical stability is virtually unaffected by the bearing element, especially as the bearing element has only relatively small dimensions compared with the remaining parts. In that case, the strength and stability can continue to be determined by the construction of the pressure plate and the cylinder body.

In an advantageous construction, the bearing element is formed from plastics material. A peripheral face of the bearing element then forms the bearing surface. Such a bearing element can be manufactured relatively easily.

The plastics material is preferably selected from the group of high-strength thermoplastic plastics materials on the basis of polyaryl ether ketones, in particular polyether ether ketones, polyamides, polyacetals, polyaryl ethers, polyethylene terephthalates, polyphenylene sulphides, polysulphones, polyether sulphones, polyether imides, polyamide imide, polyacrylates, and phenol resins, such as novolak resins. Such plastics materials can work together with metals with relatively low friction, even when there is no lubrication by oil.

The plastics material preferably has a filler of glass, graphite, polytetrafluoroethylene or carbon, especially in fibre form. The strength of the bearing element can be further increased by such a fibre filling.

The counterpart preferably has a spherical convex surface and the bearing surface has a corresponding concave surface. The counterpart therefore forms with the bearing element a ball-and-socket joint, the counterpart forming the ball and the bearing element forming the hollow ball. A complete ball and a complete hollow ball are not provided, of course. It is sufficient for corresponding annular portions of a spherical surface that slide on one another to be provided. Since the counterpart lies inside and the bearing element lies outside, exchange of the bearing element, should this be necessary, can be carried out relatively easily.

The surface of the counterpart is preferably larger than the bearing surface. The bearing element therefore always slides, possibly apart from the edge regions,, in face-to-face contact with the counterpart. Loading of the bearing surface can therefore be kept very uniform. The counterpart cannot press into the bearing surface.

The tangent to the surface of the counterpart at the end remote from the inclined plate is preferably directed essentially parallel to the axis of rotation of the cylinder body. The forces acting on the bearing element are then directed essentially radially outwards and can thus be relatively easily absorbed without the bearing element having to be of extremely large or thick dimensions.

The bearing element is preferably annularly surrounded, at least over a part of its depth, by the pressure plate. The radial forces acting on the bearing element can then be absorbed by the pressure plate. In this way, it is possible to avoid the combination comprising bearing element and pressure plate being too thick. Despite that, this combination is capable of taking up forces to a satisfactory extent.

It is also preferred for the pressure plate to have at least one bearing surface extending essentially parallel to its superficial extent and facing away from the inclined plate, and for the bearing element to have a correspondingly matched bearing surface, at least one of the two parts being stepped to form the bearing surface. This step, or more accurately, the two bearing surfaces lying adjacent to one another, can then also accommodate axially acting forces, so that the bearing element is supported. The construction of a step also enables the bearing element to be annularly surrounded by the pressure plate.

The counterpart is preferably of annular construction and surrounds an extension formed centrally on the cylinder body. The counterpart is therefore likewise in the form of a separate part. One is not then restricted in the choice of material to the material of the cylinder body. The material of the cylinder body can be selected from other considerations, for example, strength, whereas the material of the counterpart is preferably selected from the point of view of low-friction sliding contact with the bearing surface. The counterpart then merely needs to be fixed in known manner to the extension.

In that connection, it is especially preferred for the end of the counterpart remote from the inclined plate to have a cylindrical shape at its outer periphery. This facilitates manufacture of the counterpart quite considerably. At this cylindrical end there is a tool-engaging surface available which enables the counterpart to be held in a tool while the remainder of it is being shaped.

In this connection it is especially preferred for the end to have a diameter that is reduced compared to the largest diameter of the counterpart. This enables the pressure plate to be tilted further without the bearing surface of the bearing element having to absorb axial forces that are too great. Although the bearing surface is non-uniformly stressed as a result, namely, when the pressure plate reaches one end of the tilting range, this is less critical since the slider shoes in this region are in any case pressed by the piston against the inclined plate.

Advantageously, the extension is formed by a shaft, by means of which the cylinder body is rotatably mounted, the shaft being led through the pressure plate. This construction does weaken the pressure plate, but this is of lesser importance on account of the use of the bearing element. This disadvantage is more than compensated for by the fact that on the side of the cylinder body remote from the pressure plate the connections for intake and discharge of the hydraulic fluid can be positioned unobstructed by the shaft. The connections can thus be constructed so that only a very slight pressure gradient is produced from the connection to the inside of the machine. Such a construction is advantageous in particular when a relatively "hard" hydraulic fluid, for example, water, is being used.

The counterpart and the pressure plate are preferably made of steel. This enables very strong components to be made so that the ability to withstand pressure of known machines is achieved. The bearing element that is arranged between the two steel parts prevents steel on steel friction, however, so that efficiency remains high and wear and tear can be limited.

BRIEF DESCRIPTION OF THE DRAWINGS

The invention is described hereinafter with reference to a preferred embodiment and in conjunction with the drawing, in which.

DESCRIPTION OF THE PREFERRED EMBODIMENT

Figure 1:
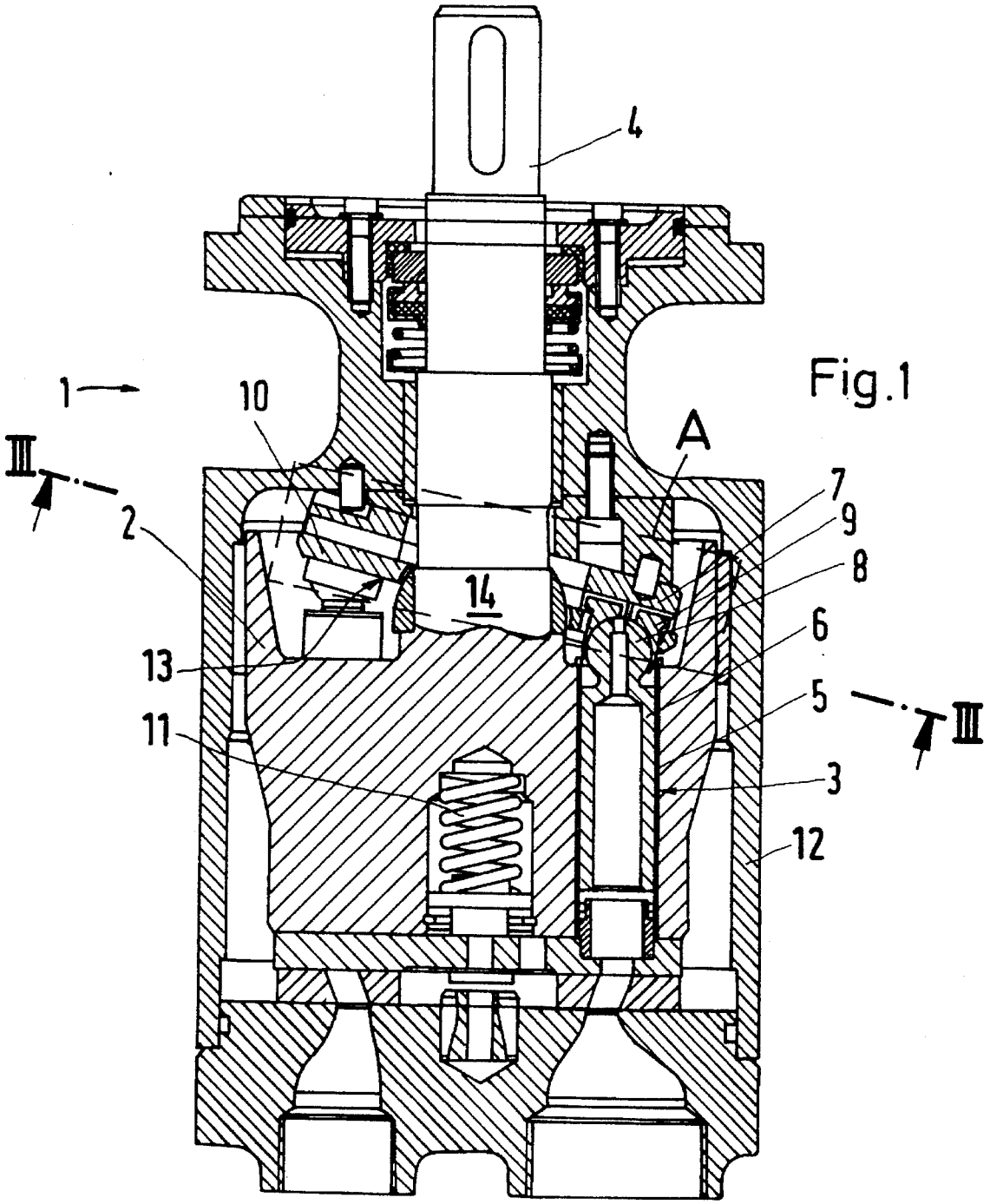
FIG. 1 shows a cross-section through a hydraulic axial piston machine.

A hydraulic axial piston machine 1 has a cylinder body 2, in which several cylinders 3 are arranged, the axes of which are parallel to the axis of the cylinder body 2. The cylinder body 2 is fixedly connected to a shaft 4, that is to say, it follows rotary movement of the shaft 4.

Each cylinder 3 has a bushing 5. A piston 6 is arranged so as to be axially displaceable in the bushing 5. The movement of the piston 6 is effected by way of an inclined plate 7, which is arranged fixedly 8 in the housing 12 and against which the piston 6 bears through a ball-and-socket joint 8 by means of a slider shoe 9. The slider shoe 9 is held by means of a pressure plate 10 against the inclined plate 7.

Whenever the cylinder body 2 performs a full rotation, the piston 6 is moved once back and forth. By changing the inclination of the inclined plate 7, the stroke volume of the piston 6 can be changed.

Of course, the cylinder body 2 can also be secured in the housing 12, if the inclined plate 7 rotates.

Figure 2:
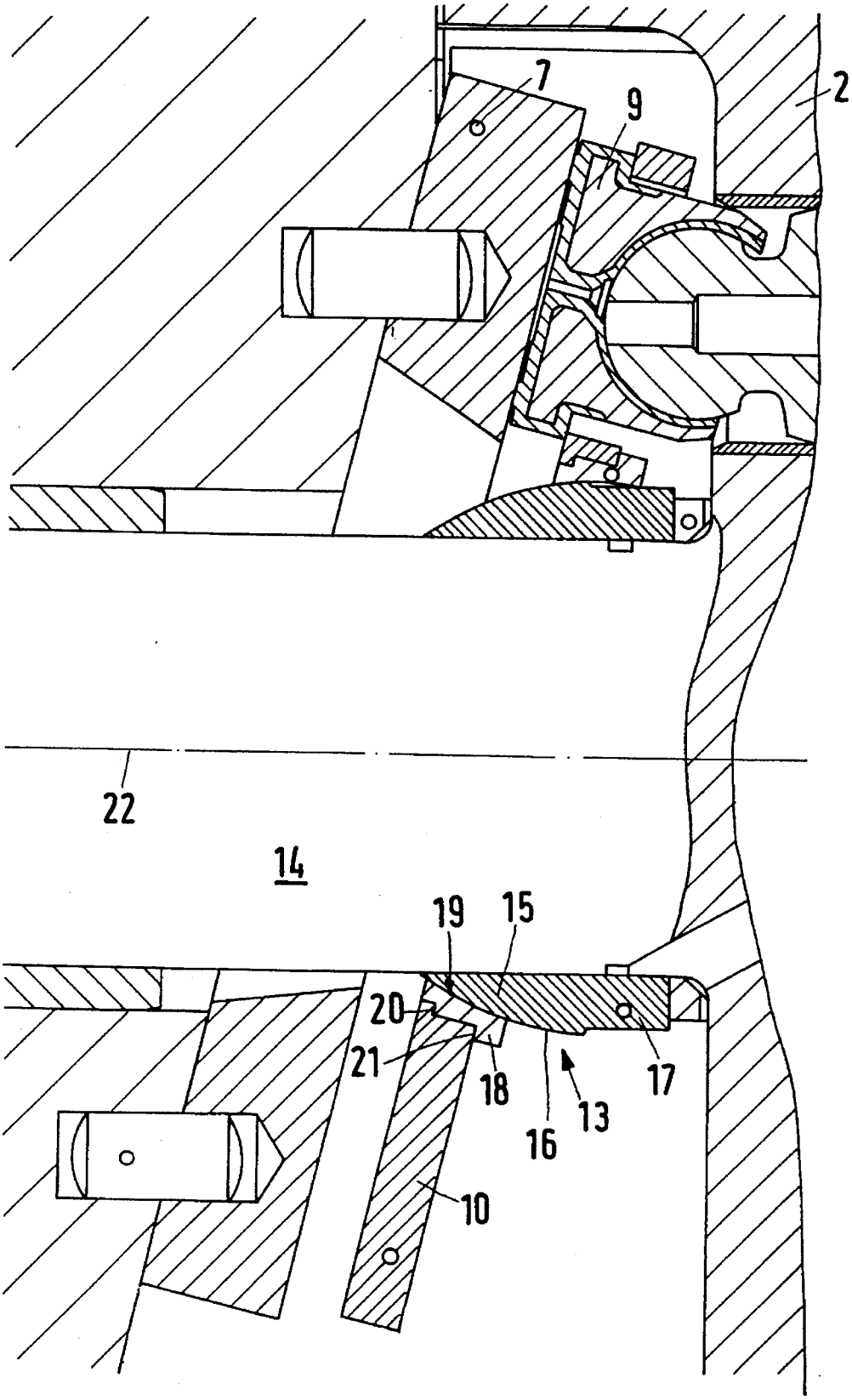
FIG. 2 shows a detail A from FIG. 1.

The pressure plate 10 is linked to the cylinder body 2 by way of a ball-and-socket joint 13, illustrated in more detail in FIG. 2. The pressure acting on the pressure plate 10, which holds the slider shoes 9 against the inclined plate 7, is generated by means of a spring 11. The shaft 4 is led through the pressure plate 10.

The ball-and-socket joint 13 consists of an annular counterpart 15 with a spherical convex surface 16 pushed onto an extension 14 of the cylinder body 2. The surface 16 thus forms a part of a surface of a sphere. The extension 14 is expediently of cylindrical construction. It is arranged in the middle of the cylinder body 2 and symmetrically with respect thereto. It is not absolutely necessary, however, for the extension 14 to be round. It can also be polygonal in cross-section if the counterpart 15 is correspondingly constructed. The extension 14 is here formed by a part of the shaft 4. At its end remote from the inclined plate 7, the counterpart 15 is of cylindrical construction, that is to say, its outer circumference is constant in a specific region 17. This region 17 has a diameter that is reduced compared with the largest diameter of the counterpart 15. It serves to hold the counterpart fixed during manufacture.

A bearing element 18, which surrounds the counterpart 15 annularly and has a spherical bearing surface 19 matched to the spherical form of the counterpart 15, works together with the counterpart 15. The bearing element 18 is formed from a plastics material which is able to slide with low friction on the material of the counterpart 15, even if no lubrication is provided there. Suitable plastics materials are, for example, polyamides, such as nylon, polytetrafluoroethylene (PTFE), or polyaryl ether ketones, such as polyether ether ketones. The bearing element 18 is surrounded annularly by the pressure plate 10. The pressure plate has two bearing surfaces 20, 21, which are directed substantially parallel to its superficial extent. The bearing element 18 has corresponding bearing surfaces with which it lies against the pressure plate 10. Both the pressure plate 10 and the bearing element 18 are stepped in this region so that the pressure plate is able to accommodate not only axial forces but also radial forces acting on the bearing element 18.

In this particular embodiment, the radial forces outweigh the axial forces. This is achieved in that the tangent to the surface 16 in the region of the end of the counterpart 15 remote from the inclined plate 7 is directed substantially parallel to the axis 22 of the cylinder body 2. Substantially parallel here means that departures up to 20° are allowed. This measure enables the regions of the counterpart 15, on which the bearing element 18 slides, to be kept relatively flat, that is to say, the surface normals on the surface 16 of the counterpart 15 always form a relatively large angle with the axis 22. In this manner the force components in the direction of the axis 22 are always much smaller than the radial force components. The radial forces can be absorbed relatively well, however, by the pressure plate surrounding the bearing element.

Because the region 17 has a reduced diameter, it is possible for the bearing element 18 to be pushed far enough onto the counterpart 15, and the pressure plate 10 can therefore be tilted far enough.

Both the counterpart 15 and the pressure plate 10 can be formed from metal, for example, steel, which gives the machine a high mechanical strength and thus permits a correspondingly high pressure loading. Despite that, metal on metal friction can be prevented by the bearing element 18. On the contrary, this bearing element 18 allows relatively low-friction sliding of the pressure plate 10 on the counterpart 15.

Figure 3:
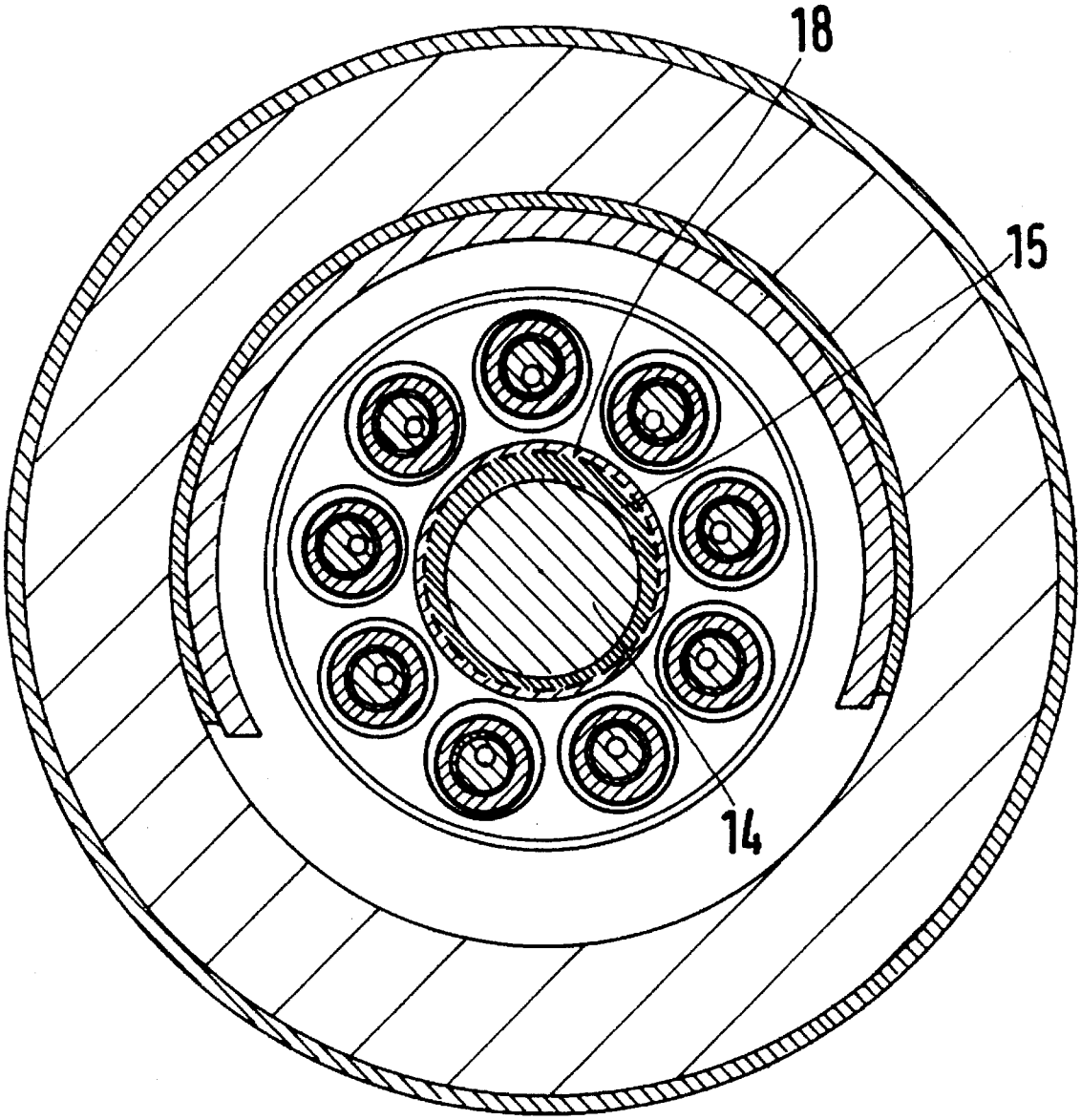
FIG. 3 shows a section III—III in accordance with FIG. 1.

FIG. 3 shows a cross-section which makes clear how the counterpart 15 is arranged on the extension 14 and is surrounded by the bearing element 18.

I claim:

1. A hydraulic axial piston machine having a inclined plate on which a slider shoe of at least one piston slides on relative movement between a cylinder body receiving the piston and the inclined plate, and a pressure plate articulated on the cylinder body and holding the slider shoe in engagement with the inclined plate, and in which between the pressure plate and cylinder body there is arranged a bearing element with a bearing surface of plastic material which slides with low friction on a counterpart made of metal lying against the bearing surface.

2. A machine according to claim 1, in which the bearing element is formed from plastic material.

3. A machine according to claim 1, in which the plastic material is selected from the group of high-strength thermoplastic materials comprising at least one of polyether ether ketones, polyamides, polyacetals, polyaryl ethers, polyethylene terephthalates, polyphenylene sulphides, polysulphones, polyether sulphones, polyether imides, polyamide imide, polyacrylates, and phenol resins, including novolak resins.

4. A machine according to claim 3, in which the plastic material has a filler of glass, graphite, polytetrafluoroethylene or carbon, said carbon including carbon in fibre form.

5. A machine according to claim 1, in which the counterpart has a spherical convex surface and the bearing surface has a corresponding concave surface.

6. A machine according to claim 5, in which the convex surface of the counterpart is larger than the bearing surface.

7. A machine according to claim 5, in which a tangent to the convex surface of the counterpart at an end remote from the inclined plate is directed essentially parallel to an axis of rotation of the cylinder body.

8. A machine according to claim 1, in which the bearing element is annularly surrounded, at least over a part of its depth, by the pressure plate.

9. A machine according to claim 1, in which the pressure plate has at least one bearing surface extending essentially parallel to its superficial extent and facing away from the inclined plate, and the bearing element has a correspondingly matched bearing surface, at least one of the pressure plate and the bearing element being stepped to form the bearing surface.

10. A machine according to claim 1, in which the counterpart is of annular construction and surrounds an extension formed centrally on the cylinder body.

11. A machine according to claim 10, in which an end of the counterpart remote from the inclined plate has a cylindrical shape at its outer periphery.

12. A machine according to claim 11, in which the remote end has a diameter that is reduced compared to a largest diameter of the counterpart.

13. A machine according to claim 10, in which the extension is formed by a shaft, the cylinder body being rotatably mounted on the shaft, the shaft extending through the pressure plate.

14. A machine according to claim 1, in which the counterpart and the pressure plate are made of steel.

* * * * *